United States Patent [19]

McKinney et al.

[11] 4,080,285

[45] Mar. 21, 1978

[54] THERMAL CRACKING OF SHALE OIL

[75] Inventors: Joel Drexler McKinney; Raynor T. Sebulsky, both of Pittsburgh; Francis Edmund Wynne, Jr., Allison Park, all of Pa.

[73] Assignee: Gulf Research & Development Company, Pittsburgh, Pa.

[21] Appl. No.: 704,334

[22] Filed: Jul. 12, 1976

[51] Int. Cl.[2] ..... C10G 9/32

[52] U.S. Cl. ..... 208/127; 208/11 R; 208/132; 260/683 R

[58] Field of Search ..... 208/11 R, 127, 132; 260/683 R

[56] References Cited

U.S. PATENT DOCUMENTS

| | | | |
|---|---|---|---|
| 2,526,696 | 10/1950 | Schutte | 208/54 |
| 2,885,275 | 5/1959 | Rees | 208/132 |
| 3,039,955 | 6/1962 | Honnold | 208/132 |
| 3,093,571 | 6/1963 | Fish et al. | 208/11 R |
| 3,712,800 | 1/1973 | Schutte | 208/127 X |

*Primary Examiner*—Herbert Levine

[57] ABSTRACT

A process for the non-catalytic riser cracking of shale oil to produce ethylene in the presence of entrained hot, inert solids.

10 Claims, 5 Drawing Figures

THERMAL CRACKING OF SHALE OIL

Figure 1A:
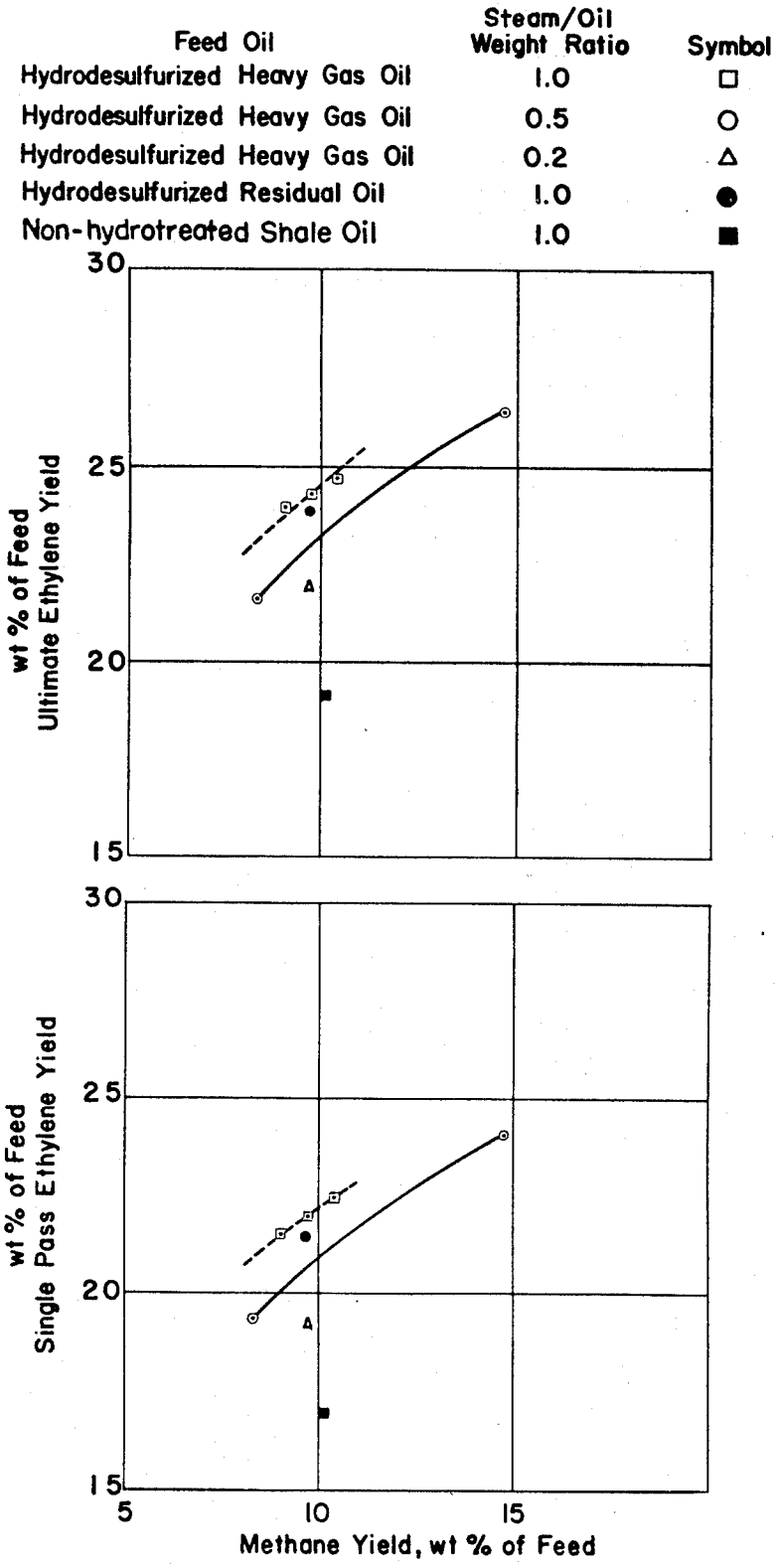

This invention relates to a process for non-catalytic thermal cracking of shale oil in the presence of a gaseous diluent and an entrained stream of inert heat carrier solids.

The present cracking process is directed towards the recovery of gaseous olefins as the primarily desired cracked product, in preference to gasoline range liquids. At least 15 or 20 weight percent of the feed oil is converted to ethylene. While ethylene is the single most prevalent gaseous product most of the feed oil is converted to both other gaseous products and to liquid products. Other valuable hydrocarbon gaseous products include propylene and 1,3-butadiene. Other $C_4$'s and ethane are also produced. Hydrogen is recovered as a valuable non-hydrocarbon gaseous product. Liquid products are produced in the cracking process by combination of intermediate olefinic material in the reactor and can comprise 40 or 50 weight percent or more of the total product. Recovered liquid products include benzene, mixtures of benzene, toluene and xylenes (BTX), gasoline boiling range liquids and light and heavy gas oils. The economic value of the various gaseous and liquid hydrocarbon products is variable and depends upon prevailing market conditions. Coke is a solid product of the process and is produced by polymerization of unsaturated materials. Most of the coke formed is removed from the process as a deposit upon the entrained inert heat carrier solids.

The proportions of the various products obtained depend significantly upon cracking severity, which can be expressed in terms of methane yield since methane is the ultimate hydrocarbon product. At a low severity, i.e. at methane yields below about 4 or 6 weight percent based on feed oil, yields of most products will be low. At a moderate severity, i.e. at methane yields above about 4 or 6 but below about 12 or 14 weight percent, optimum yields of intermediate olefins such as propylene and 1,3-butadiene will be realized. At high severities, i.e. at methane yields above about 12 or 14 weight percent, yields of propylene and 1,3-butadiene will decline and yields of very light materials, such as methane, hydrogen, and ethylene will tend to increase.

In the thermal cracking operation, a stream of hot solids supplied at a temperature above the average thermal cracker temperature is mixed with feed oil and a gaseous diluent, such as steam or other vapor, both supplied at a temperature below the average cracking temperature. There is no need to charge gaseous hydrogen to the thermal cracker. The components in the resulting mixture of feed oil, gaseous diluent and entrained solids flow concurrently through the thermal riser at an average riser temperature of 1,300° to 2,500° F. (704° to 1,371° C.) for a residence time between about 0.05 and 2 seconds. Endothermic cracking occurs in the thermal cracker so that the highest temperature occurs near the inlet of the riser, with the temperature falling slightly and gradually along the length of the riser. The thermal cracking reactor is elongated and has a high length to diameter ratio in the range of 4:1 to 40:1, generally, or 6:1 to 20:1, preferably. The reactor can be disposed either vertically or horizontally. Direction of flow is not important and in a vertically disposed riser flow can be directed either upwardly or downwardly. Most commonly, the reactor will be an elongated riser with preheated feed oil, steam diluent and hot solids flowing concurrently upwardly or downwardly through the riser at a sufficiently high velocity that the heat carrier solids are carried in entrained flow through the riser by flowing vapors. More than 98 or 99 percent of the hot solids flowing to the riser are recirculated solids. Essentially the only solids bled off from the solids circulation system are solids or ash contained in the feed oil or very fine solids resulting from attrition of the heating solids. The size of the entrained solid particles is not important as long as the solids are sufficiently small that there is little or no slippage between the inert solids and the flowing gases. Henceforth, for convenience the thermal cracking reactor will be considered to be a vertical upflow riser with steam as the diluent vapor.

The thermal reactor of the present invention is to be distinguished from a coil thermal cracking reactor which does not utilize hot solids as an internal heat carrier agency but wherein feed oil and steam diluent flow occurs through a coil disposed in a radiant, reflective furnace chamber enclosing an open flame. In the coil type reactor the flowing stream progressively becomes heated in transit through the coil so that the stream is at its lowest temperature at the coil inlet and progressively becomes heated during passage through the coil so that it is discharged from the coil at its highest temperature. Because a coil reactor is dependent for its heat requirements upon heat transfer across the wall of the coil and along the cross-section of the coil, the diameter of the coil must be considerably smaller than the diameter of the thermal riser of the present invention in order to provide a high ratio of heat transfer surface to tube cross-section. The thermal riser of the present invention can have a considerably larger diameter than the coil reactor since all the heat is added directly to the interior of the riser by means of hot inert solids. Most of the heat is carried into the interior of the riser by the hot inert solids while a smaller portion of heat is carried into the riser by diluent steam and preheated oil. Therefore, no heat transfer is required across the riser wall. Due to the endothermic nature of the reaction and because heat is not added across the reactor wall, the maximum inlet riser temperature gradually declines along the length of the reactor. This temperature gradient along the reactor is opposite to that of the coil reactor wherein a gradual temperature increase occurs along the length of the coil due to continual inward transfer of heat across the coil wall from the surrounding flame. The use of hot inert solids as a heat source is considerably more thermally efficient than an external flame because the temperature of the flame surrounding a coil cracker is generally about 2,800° F. (1,538° C.), while the temperature of the hot solids supplied to a riser is typically about 1,700° F. (927° C.).

During operation of the coil reactor, coke is continually deposited upon the walls of the coil. Because of the small diameter of the coil, e.g. about 5 inches (12.7 cm), or less, any deposited coke forms a relatively thick layer, thereby severely inhibiting further heat transfer across the coil and tending to plug the coil. Therefore, a coil cracker cannot tolerate more than about 0.5 weight percent conversion of the feed oil to coke. If coke conversion is above this level, frequent and costly decoking with steam or air is required. Therefore, the coil reactor is most efficiently used for cracking ethane, propane, butane and light oils, such as naphtha, and exhibits greatly depressed ethylene yields when the charge comprises a heavier oil, such as light gas oil or heavy gas oil. When cracking heavier oils, the coil cracker cannot operate at as high severities, as indicated by methane yield, as the process of the present invention, since coke deposits tend to increase with increasing cracking severity. This coking tendency is so pronounced with residual oils that cracking of residual oils in a coil cracker to produce olefins is not considered to be a feasible operation.

The oil feed to a coil cracker does not generally require desulfurization because although the coke formed contains most of the sulfur content of the feed oil, it is not subsequently burned. In contrast, the coke deposited on the solids of the present process is subsequently continuously burned in an external burner so that the sulfur in the feed oil is continuously emitted to the atmosphere as sulfur oxide pollutant. Therefore, in the present process if prevailing air pollution standards are to be met without resorting to stack gas scrubbing, high sulfur feed oil must be desulfurized to an extent which results in a sulfur oxide emission less than about 250 to 500 ppm by volume in the burner flue gas.

It is a particular advantage of the present process that some of the hydrogen consumed during desulfurization of the feed oil is recovered as molecular hydrogen. The hydrogen that is recovered is the hydrogen that is chemically combined with the hydrocarbon molecule, as contrasted to hydrogen that is converted to hydrogen sulfide. This hydrogen can be recovered since the high temperature thermal cracking process yields an olefinic product by splitting the relatively stable hydrogen to carbon bonds to produce free hydrogen, in addition to splitting the less stable carbon to carbon bonds. The present thermal cracking process is thereby contrasted to lower temperature cracking processes wherein the product is primarily paraffinic because cracking occurs by splitting carbon-carbon bonds and stops short of splitting the more stable carbon-hydrogen bonds.

Operation of the thermal riser of the present invention is not limited by coke formation on the reactor wall as in the case of the coil reactor because heat transfer across the reactor wall is not required and because the hot solids entrained in the reactor stream provide both a surface for the deposit of coke and a vehicle for its removal. Thereby, the entrained solids continuously carry off from the reactor most of the coke as it is formed. When heat is supplied internally, rather than across the riser wall, the diameter of the riser can be very large, for example about 30 to 40 inches (76.2 to 101.6 cm). Although most of the coke formed is carried out of the riser as particulate coke both on and off of the solids, some is dissolved in the heavy oils produced in the riser.

The entrained coke-coated solids leaving the thermal riser are passed to a burner wherein the coke is burned from the surface of the solids to both remove the coke and to heat the solids and thereby supply the required heat for the thermal cracking reaction during the next pass. While complete burn off will usually take place, such is not necessary and some coke can be recycled on the solids. Continuous addition to and removal of solids from the burner moderates combustion temperature and thereby tends to reduce or prevent formation of noxious nitrogen oxides from nitrogen present in the combustion air, which can occur during high temperature combustion. Since the solids do not normally contain sufficient coke to adequately heat the solids, supplementary fuel is supplied to the burner in the form of torch oil. Hot, substantially coke-free solids are continuously removed from the burner and are recycled to the bottom of the thermal cracking riser to provide heat thereto. The thermal cracking process of the present invention requires a supply of hot solids at only a single temperature for admixture with feed oil to accomplish cracking and does not require a plurality of solid streams at different temperatures.

Use of inert solids to continuously carry coke deposits from the reactor, rather than permitting them to accumulate within the reactor and plug it, permits thermal cracking to be performed at a high severity. Thermal cracking at a high severity can be an advantageous mode of operation. Although propylene and butadiene yields reach a peak at moderate severities and then decline, the yields of other highly valuable products tend to increase with increasing severity, including ethylene (which tends to attain a relatively flat, elevated yield level at high severities), methane, aromatics and hydrogen. A thermal riser of this invention is capable of operating with higher boiling feedstocks, at higher severities as measured by methane yield or other severity criteria and with lower levels of steam dilution to achieve a given ethylene yield, as compared to a coil thermal cracker which does not employ hot solids.

In a thermal riser of this invention, the average riser temperature is between about 1,300° and 2,500° F. (704° and 1,371° C.), generally, between about 1,400° and 2,000° F. (760° and 1,093° C.), preferably, and between about 1,430° and 1,850° F. (777° and 1010° C.), most preferably. The feed oil can be preheated in advance of the riser, if desired, or feed oil preheating can be omitted. If the oil is preheated, any preheating temperature up to the temperature of oil vaporization or coking can be employed. Immediately upon leaving the riser, the product stream should be quenched to a temperature below about 1,300° F. (704° C.). Cold solids, water, steam and recycle oils are examples of suitable quench materials. A quench temperature below 1,300° F. (704° C.), such as between about 890° and 1,300° F. (477° and 704° C.), is suitable.

A dispersant gas, preferably steam, is supplied to the oil preheater or to the riser, if desired, in any amount up to about 2 pounds per pound (908 gm. per gm.) of hydrocarbon feed. The quantity of steam required tends to increase as the boiling point of the feedstock increases. A highly paraffinic feedstock generally requires less steam than a highly olefinic or alkyl aromatic feedstock. Although the use of steam favorably influences ethylene yield and selectivity, it is a very costly factor in cracker operation. As steam consumption increases, a point approaches where the cost of additional steam and the cost of its condensation is not compensated by the incremental ethylene yield or selectivity. Every incremental increase of steam employed must be more than compensated by the value of the resulting incremental increase in yield of ethylene or other products.

The pressure employed in the riser should be adequate to force the riser effluent stream through the downstream separation equipment. The pressure will be between about 3 and 100 psig (0.2 and 7 kg/cm$^2$), generally, and between about 5 and 50 psig (0.35 and 3.5 kg/cm$^2$), preferably. A pressure above about 15 psig (1.05 kg/cm$^2$) will usually be required. The riser residence time can be between about 0.05 and 2 seconds, generally, or between about 0.05 and 0.5 seconds, preferably. Higher residence times induce either undesired olefin polymerization reactions or undesired cracking of light or heavy products. The weight ratio of solids to feed oil can be between about 4:1 and 100:1, generally, and between about 10:1 and 30:1, preferably. The hot solids can be supplied to the riser at any temperature which is at least about 50° F. (27.8° C.) above the riser outlet temperature, up to a maximum temperature of about 2,500° F. (1,371° C.). The temperature of the solids supplied to the riser will be about the temperature within the coker burner. Only one stream of solids at the desired temperature is generally required for the cracking operation. Any catalytically inert material or mixture can serve as the solid heat carrier. Suitable materials include non-catalytic alumina, alundum, carborundum, coke, deactivated catalyst, etc. Neither the particle size nor the surface area of the inert solids is critical. Any size capable of passing through the riser in entrained flow with the reactant oil and steam diluent with little or no slippage can be employed. In one particular but non-limiting example, a particle size range of 5 to 150 microns with an average size of 70 microns, was supplied to the riser. During use, the particles undergo abrasion and reduction to a smaller size. The heat content in the solids entering the riser should be sufficient to supply at least 80 or 90 percent of the heat requirement of the cracker, which is approximately 350 BTU per pound of feed oil. This constitutes the entire heat supply beyond preheat of feed oil and the heat content of the diluent gas.

In the operation of the cracker riser, since methane is the ultimate hydrocarbon cracked product, an increasing methane yield is an indication of increasing severity. There are many ways that cracker severity can be changed. For example, changes can be made in temperature, residence time, feedstock, solids to oil ratio or recycle of crackable paraffins and olefins such as ethane, propane, propylene and butane. Because the solids riser can tolerate high coke yields, wide variations in severity are possible. While coil cracking of propylene is usually avoided because of a tendency of this material to coke, the present cracking process can recycle $C_3$, $C_4$ and $C_4$+ olefins, if desired.

An additional important advantage associated with the use of a solids heat carrier to supply more than 80 or 90 percent of the total cracker heat requirement arises when relatively high boiling feed oils are employed. If heavy oil fractions are subjected to excessive preheating in a coil preheater, they would tend to coke, thereby plugging and reducing the heat transfer efficiency of the preheater. In accordance with the present invention, preheating of heavy feed oils to the extent of inducing significant cracking or coking is avoided, and significant cracking or coking first occurs in the riser in the presence of the heat carrier solids. The heavy feed oils are not subjected to the most elevated process temperatures until contact with hot solids at the bottom of the riser.

In the thermal cracker, a number of secondary reactions occur which compete with the primary cracking reactions and which necessitate the very low residence times of the present invention. Olefins present in the feedstock or produced by cracking are not only more refractory to further cracking than are paraffins, but in addition they can condense to produce benzene, toluene, xylene and other aromatics. For this reason, olefinic feedstocks tend to be improved by hydrogenation. The aromatic materials produced have a variable economic value, depending upon market conditions. Higher molecular weight aromatics are also produced. An unstable aromatic gasoline boiling range fraction is formed as well as aromatic light gas oil and heavy gas oil fractions. The higher boiling feedstocks of a given molecular type composition produce the most coke and heavy oil.

The heavier liquid product fractions can be utilized as a torch oil in the burner to supplement the fuel value of the coke on the solids. Torch oil is a lower cost fuel than the gas and naphtha fuels normally employed to provide the uniform radiant heat required in the furnace of a coil cracker. In the burner, the coke-laden solids are subjected to burning in the presence of air at a temperature above 1,700° F. (927° C.). The burner flue gases can be passed to an energy recovery unit, such as steam generator or a turbo-expander. The flue gases should contain less than about 250 to 500 ppm by volume of sulfur oxides in order to be environmentally acceptable. Otherwise, a stack gas scrubber will be required. Because of the elevated combustion temperatures, the concentration of carbon monoxide will be low even with little excess air. The relatively coke-free hot solids are returned to the riser.

The total product from the thermal riser can be separated into a plurality of distinct product fractions. The lightest fraction will comprise methane and hydrogen in a ratio of one mole of hydrogen to two moles of methane. Since an increase in methane yield is an indication of an increase in process severity, high severity processes provide the advantage of high hydrogen yields. The methane and hydrogen can be separated from each other in a cryogenic unit. The ethylene product fraction comprises the highest volume gaseous olefin product. Paraffinic feeds produce the highest ethylene yields, while aromatic feed components are refractory and do not tend to produce ethylene. As cracking temperatures and residence times increase, the ethylene yield reaches a flat maximum. Ethane, propane and propylene can each be separately recovered. A $C_4$ cut can be recovered. The $C_4$'s will comprise butanes, butenes and butadiene with traces of other $C_4$'s. Butadiene can be separated from the mixture for sale. A $C_5$–$C_{10}$ cut can be recovered as a source of gasoline and aromatics. Of the total 430° F. + (221° C.+) heavy oil product the heaviest portion can be used as torch oil in the process burner; can be hydrotreated and sold as fuel; or can be used to produce needle coke or binder pitch. About 12 to 15 percent of the feed oil to the thermal cracker is required as fuel in the burner to reheat the solids. This fuel can be derived primarily from process coke, with supplemental fuel, if any, coming from the heaviest liquid products of the process. A coke yield of 3 to 5 weight percent based on feed will generally be supplemented as fuel with heavy oil in a quantity of up to about 15 weight percent based on feed to provide adequate process heat.

In accordance with the present invention, retorted shale oil comprises the feedstock for the thermal cracker. It is an advantageous feature of this invention that retorted shale oil can be employed as a feedstock in a non-hydrotreated and a non-filtered condition. When shale oil is charged to the thermal riser in a non-filtered condition the solid material it contains is continuously removed by deposition upon the entrained inert solids or the solid material can form a fine carbon plus ash particle from which the carbon can be burned leaving the ash to be either circulated or removed as fines in the process dust collection system. The carbonaceous content of the deposited material is subsequently burned and thereby disposed of in the process burner. In this manner, the inert solids used in the thermal cracker constitute a preexistent vehicle for the separation, removal and disposition of shale oil solids and therefore permits circumvention of an otherwise very costly shale oil filtering or other solids-removal operation.

We have discovered that the cracked product obtained from a shale oil feedstock exhibits certain surprising characteristics. Even though the feed shale oil is not hydrotreated, we have found that the hydrogen yield is as great as the hydrogen yield obtained by thermal cracking of a hydrotreated petroleum distillate heavy gas oil and is only slightly lower than that obtained by cracking a hydrotreated petroleum residual oil which has undergone about 95 percent desulfurization. For example, in comparative thermal cracking tests performed at about the same cracking severity wherein a hydrodesulfurized petroleum distillate heavy gas oil containing 12.69 weight percent hydrogen yielded 0.8 percent molecular hydrogen, a hydrodesulfurized residual petroleum oil containing 12.47 weight percent hydrogen yielded 0.9 weight percent molecular hydrogen, while a non-hydrotreated shale oil containing only 11.1 weight percent hydrogen yielded 0.8 weight percent molecular hydrogen. Since hydrogen is a highly valuable commodity, the recovery during thermal cracking of an unexpectedly high yield of molecular hydrogen from a relatively low hydrogen feedstock is a considerable advantage.

The discovery of a high recovery of hydrogen from shale oil during thermal cracking is particularly surprising in view of the highly aromatic and olefinic nature of shale oil. For example, a representative shale oil contained 54 percent aromatics, 28 percent olefins and only 18 percent saturates. Aromatics and short chain olefins are inferior to saturates as feedstock components because they are more refractory than saturates. In addition, because these materials have a lower hydrogen content than saturates it would be expected that they would produce a lower hydrogen yield. A further surprising result of thermal cracking of shale oil is the recovery of a relatively low aromatics content in the cracked product, while a high aromatics content would be expected in view of the high feed aromatic content.

It was further observed that thermal cracking of shale oil resulted in a 1,3-butadiene yield as great as that obtained by cracking a hydrotreated petroleum heavy gas oil. This is a considerable advantage because, next to ethylene, 1,3-butadiene is generally the most valuable hydrocarbon product of the thermal cracking operation.

EXAMPLE

Tests were performed to compare thermal cracking of a hydrodesulfurized petroleum heavy gas oil, a hydrodesulfurized petroleum residual oil and a non-hydrotreated and non-filtered retorted shale oil.

Following is the analysis of the feed heavy gas oil, both before and after hydrodesulfurization.

| DESULFURIZED KUWAIT HEAVY GAS OIL | Before Hydrodesulfurization | After Hydrodesulfurization |
|---|---|---|
| Flash Point: ° F. (° C.) | | 230.0(110) |
| Viscosity: SUS at 210° F. | | 44.2 |
| Pour Point: ° F. (° C.) | | +90.0(32.2) |
| Carbon Residue, Ramsbottom: wt. % | | 0.09 |

-continued

| DESULFURIZED KUWAIT HEAVY GAS OIL | Before Hydrodesulfurization | After Hydrodesulfurization |
|---|---|---|
| Aniline Point: ° C. | | 87.0 |
| Gravity: API | | 28.0 |
| Specific Gravity: 60/60° F. (15.6/15.6° C.) | | 0.887 |
| Carbon: Wt. % | 85.07 | 86.69 |
| Hydrogen: Wt. % | 12.05 | 12.69 |
| Sulfur: Wt. % | 2.83 | 0.10 |
| Nitrogen: Wt. % | | 0.047 |
| Nickel: ppm | | 0.10 |
| Vanadium: ppm | | <0.10 |
| Hydrocarbon Types: Vol. % | | |
| Isoparaffin | | 14.2 |
| Normal Paraffin | | 3.1 |
| Cycloparaffin | | 34.8 |
| Noncondensed | | 21.6 |
| Condensed | | 13.2 |
| 2 Ring | | 6.9 |
| 3 Ring | | 3.0 |
| 4 Ring | | 1.7 |
| 5 Ring | | 0.8 |
| 6 Ring | | 0.7 |
| Aromatics | | 45.2 |
| Benzenes | | 17.7 |
| Distillation, D1160: at 760 mm | | |
| Vol. % | | ° F. (° C.) |
| 10 | | 669.2(354) |
| 30 | | 755.6(402) |
| 50 | | 820.4(438) |
| 70 | | 874.4(468) |
| 90 | | 944.6(507) |
| EP | | 1,005.8(541) |

It is seen from the above table, that the accomplishment of nearly complete desulfurization of a heavy gas oil resulted in an increase in hydrogen content in the oil equal to 0.64 weight percent of the oil. A similar degree of hydrodesulfurization of residual oil results in an increase of hydrogen content in the oil equal to about 1.5 weight percent of the oil.

Following is an analysis of hydrodesulfurized residual oil.

| HYDRODESULFURIZED RESIDUAL OIL | |
|---|---|
| Flash Point: ° F. (° C.) | 197.6(91.5) |
| Pour Point: ° F. (° C.) | +5(−15) |
| Carbon Residue: Wt. % | 2.23 |
| Aniline Point: ° C. | 92 |
| Gravity: API | 25.8 |
| Carbon: Wt. % | 87.27 |
| Hydrogen: Wt. % | 12.47 |
| Sulfur: Wt. % | 0.14 |
| Nitrogen: Wt. % | 0.087 |
| Nickel: ppm | 0.2 |
| Vanadium: ppm | <0.1 |
| Hydrocarbon Type: Wt. % | |
| Saturates | 47.8 |
| Aromatics | 46.9 |
| Polar Compounds | 5.3 |
| Hydrocarbon Type: Vol. % | |
| Saturates | 46.4 |
| Alkanes | 15.3 |
| Naphthenes | 31.1 |
| Noncondensed | 18.5 |
| Condensed | 12.6 |
| Aromatics | 48.3 |
| Benzenes | 18.9 |
| Distillation, D1160: at 760 mm | |
| Vol. % | ° F. (° C.) |
| 5 | 538(281) |
| 10 | 587(308) |
| 20 | 660(349) |
| 30 | 722(383) |
| 40 | 777(414) |
| 50 | 833(445) |
| 60 | 892(478) |
| 70 | 970(521) |
| 80 | 1,055(568) |
| 90 | 1,086(586) |

-continued

| HYDRODESULFURIZED RESIDUAL OIL |
|---|
| 95 cracked at 769° F. (409° C.) at 10 mm |

Following is an analysis of the non-hydrotreated and non-filtered shale oil.

| TOSCO SHALE OIL | |
|---|---|
| Flash Point: ° F. (° C.) | 100(38) |
| Viscosity, SUV: sec at 100° F. (38° C.) | 162 |
| Pour Point: ° F. (° C.) | +75(24) |
| Carbon Residue: Wt. % | 3.54 |
| Gravity: API | 20.7 |
| Specific Gravity: 60/60° F. (15.6/15.6° C.) | 0.9297 |
| Carbon: Wt. % | 84.52 |
| Hydrogen: Wt. % | 11.14 |
| Sulfur: Wt. % | 0.70 |
| Nitrogen: Wt. % | 1.99 |
| Oxygen, Total: Wt. % | 1.32 |
| Water and Sediment: Vol. % | 0.4 |
| Neutralization Number (TAN) | 1.0 |
| Ash: Wt. % | 0.67 |
| Nickel, Calc: ppm | 4.1 |
| Vanadium, Calc: ppm | 0.5 |
| Distillation: ° F. (° C.) | |
| Over Point: | 263(128) |
| Vol. % Condensed at | |
| <1 | 284(140) |
| 3 | 320(160) |
| 10 | 392(200) |
| 14 | 428(220) |
| 17 | 464(240) |
| 21 | 500(260) |
| 23 | 518(270) |
| 27 | 554(290) |
| 33 | 590(310) |
| 66.5 Residue after | 590(310) |
| 0.5 Loss | — |

Following are one set of conditions employed during the thermal cracking tests.

| Feed Oil | Hydrodesulfurized Residual Oil | Shale Oil | Hydrodesulfurized Heavy Gas Oil |
|---|---|---|---|
| Operating Conditions | | | |
| Feed Preheat Temp.: ° F. (° C.) | 302(150) | 305(152) | 312(156) |
| Solids Preheat Temp.: ° F. (° C.) | 1,735(946) | 1,735(946) | 1,758(959) |
| Riser Avg. Temp.: ° F. (° C.) | 1,513(823) | 1,511(821) | 1,537(836) |
| Lower Riser Inlet Temp.: ° F.: (° C.) | 1,517(825) | 1,493(812) | 1,638(892) |
| Upper Riser Outlet Temp.: ° F. (° C.) | 1,465(796) | 1,477(803) | 1,499(815) |
| Primary Quench Temp.: ° F. (° C.) | 1,188(643) | 1,197(648) | 1,202(650) |
| Steam to Feed Weight Ratio | 0.997 | 0.981 | 0.987 |
| Solids to Feed Weight Ratio | 10.1 | 10.4 | 10.0 |
| Reactor Pressure: psia (kg/cm$^2$) | 24.16(1.7) | 24.30(1.7) | 24.28(1.7) |
| Reactor Velocity: ft/sec (m/min) | 30.19(549) | 29.78(549) | 27.94(549) |
| Reactor Residence Time: Sec. | 0.334 | 0.341 | 0.331 |

Figure 1B:
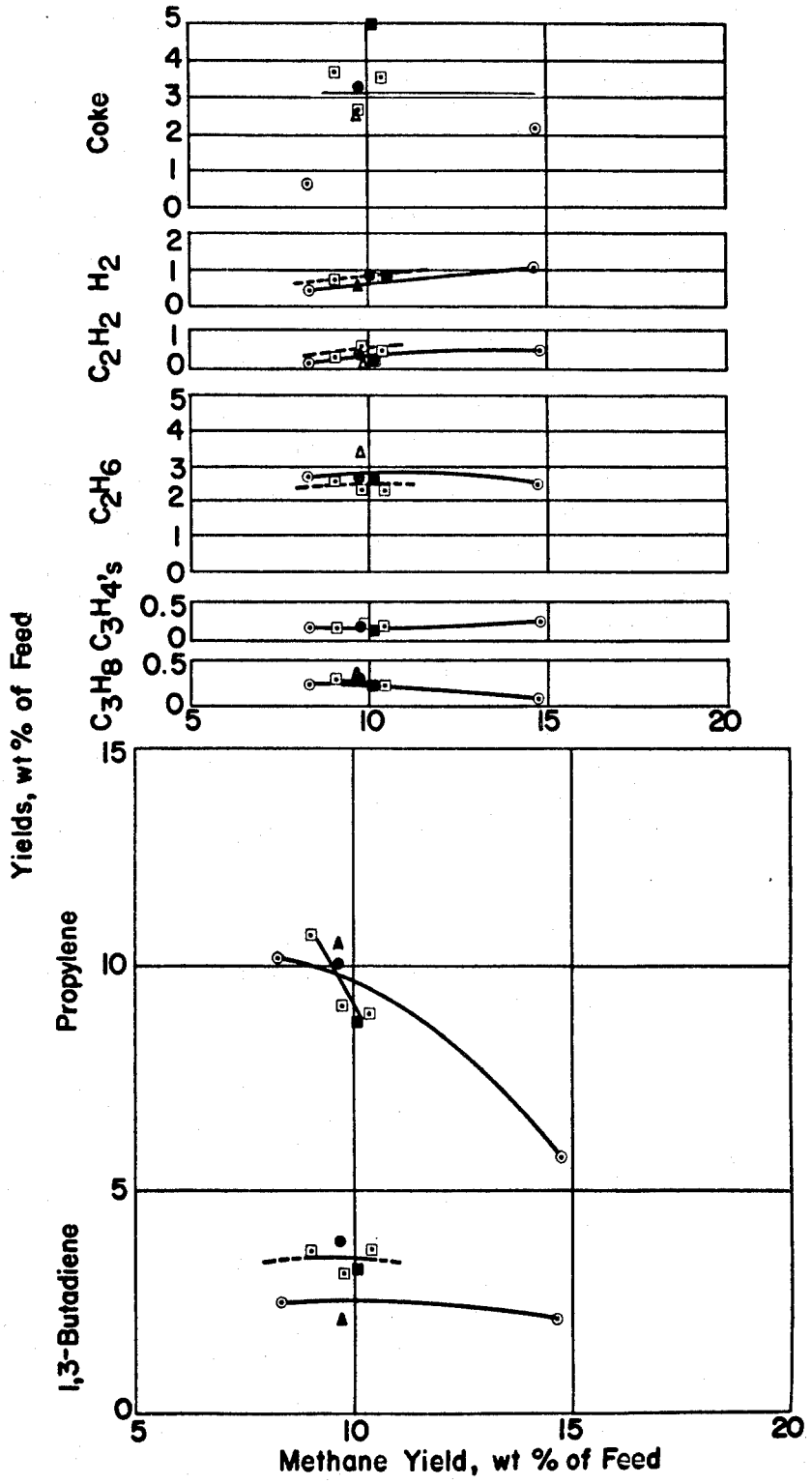
Figure 1C:
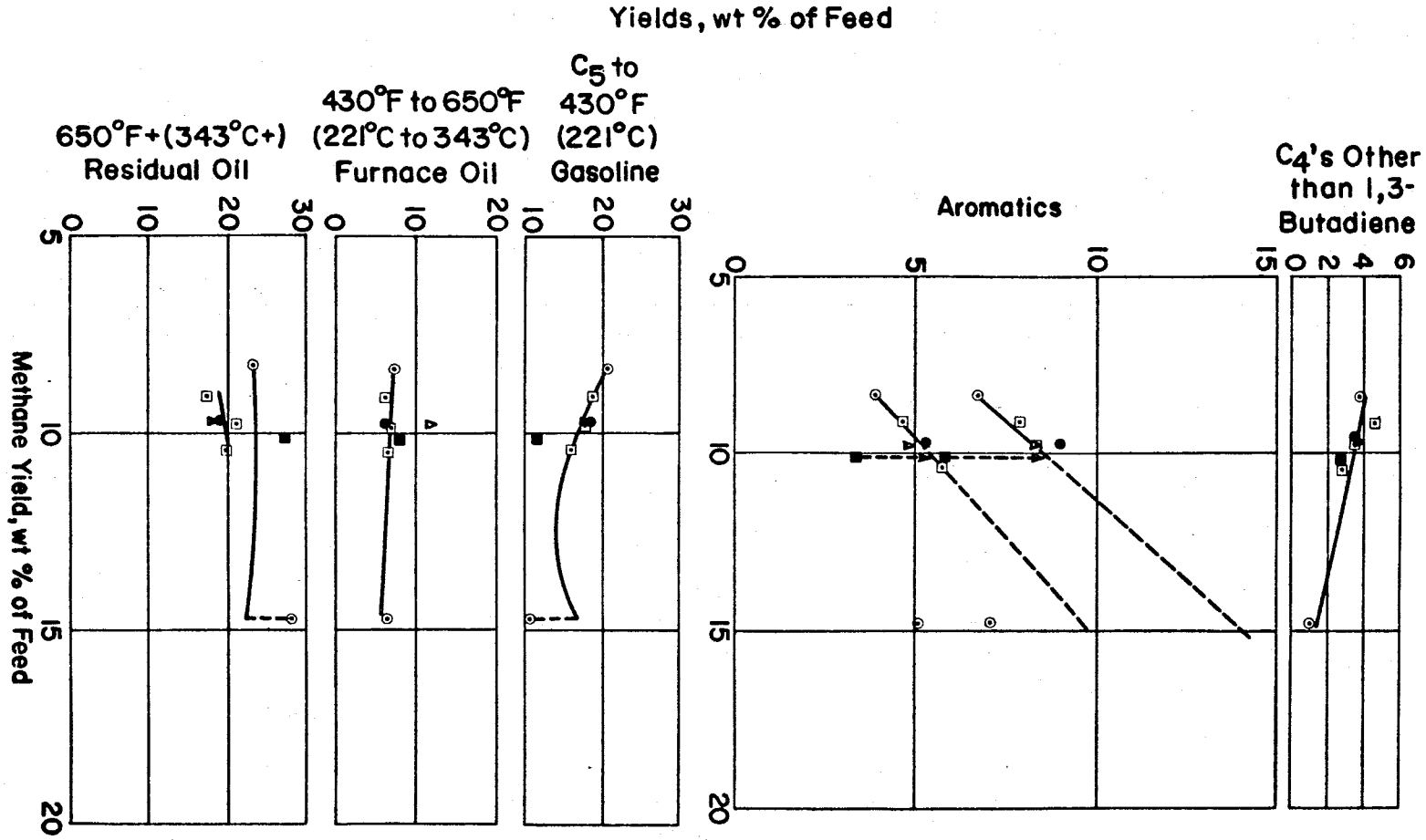

FIGS. 1A, 1B and 1C show the yields of the various products obtained by thermal cracking in the presence of entrained hot, inert solids of hydrodesulfurized petroleum heavy gas oil, hydrodesulfurized petroleum residual oil and non-hydrotreated shale oil at the indicated ratios of steam to feed oil. As shown, increasing steam to oil ratios favorably affect ethylene and other yields. Cracking severities are expressed in terms of methane yield. Cracked products represented in the table include ultimate ethylene yield (ethylene plus 0.8 times the sum of ethane and actylene), single pass ethylene yield, coke, hydrogen, $C_2H_2$, $C_2H_6$, $C_3H_4$'s, $C_3H_8$, propylene, 1,3-butadiene, $C_4$'s other than 1,3-butadiene, aromatics (BTX), gasoline, furnace oil and residual oil.

FIG. 1B shows the surprising result that at a similar steam to oil ratio and cracking severity the non-hydrotreated shale oil produces approximately as high a hydrogen yield as is obtained from both the hydrotreated residual oil and the hydrotreated heavy gas oil, even though the feed shale oil has a lower hydrogen content than either of the other two oils. FIG. 1B also shows that at a similar steam to oil ratio and cracking severity the shale oil provides approximately as high a propylene and 1,3-butadiene yield as the other two feedstocks. Propylene and 1,3-butadiene are both valuable by-products in the ethylene cracking operation.

Figure 2:
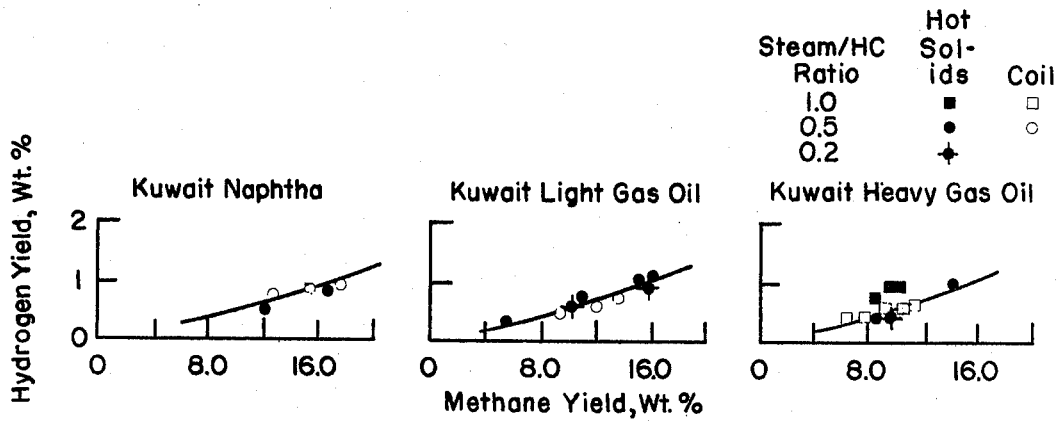

FIG. 2 shows hydrogen yields obtained when thermally cracking three oils; a non-hydrotreated naphtha; a hydrodesulfurized light gas oil and a hydrodesulfurized heavy gas oil, each oil being cracked both in a coil without hot solids and in a riser with hot solids. FIG. 2 shows that the hydrogen yield declines in the coil cracker as the boiling point of the feed oil increases but that the hydrogen yield remains constant in the hot solids riser cracker as the boiling point of the feed oil increases. FIG. 2 therefore indicates that the high hydrogen yield obtainable during thermal cracking of the relatively high boiling shale oil feedstock of this invention is specific to the use of a hot solids thermal cracker.

Figure 3:
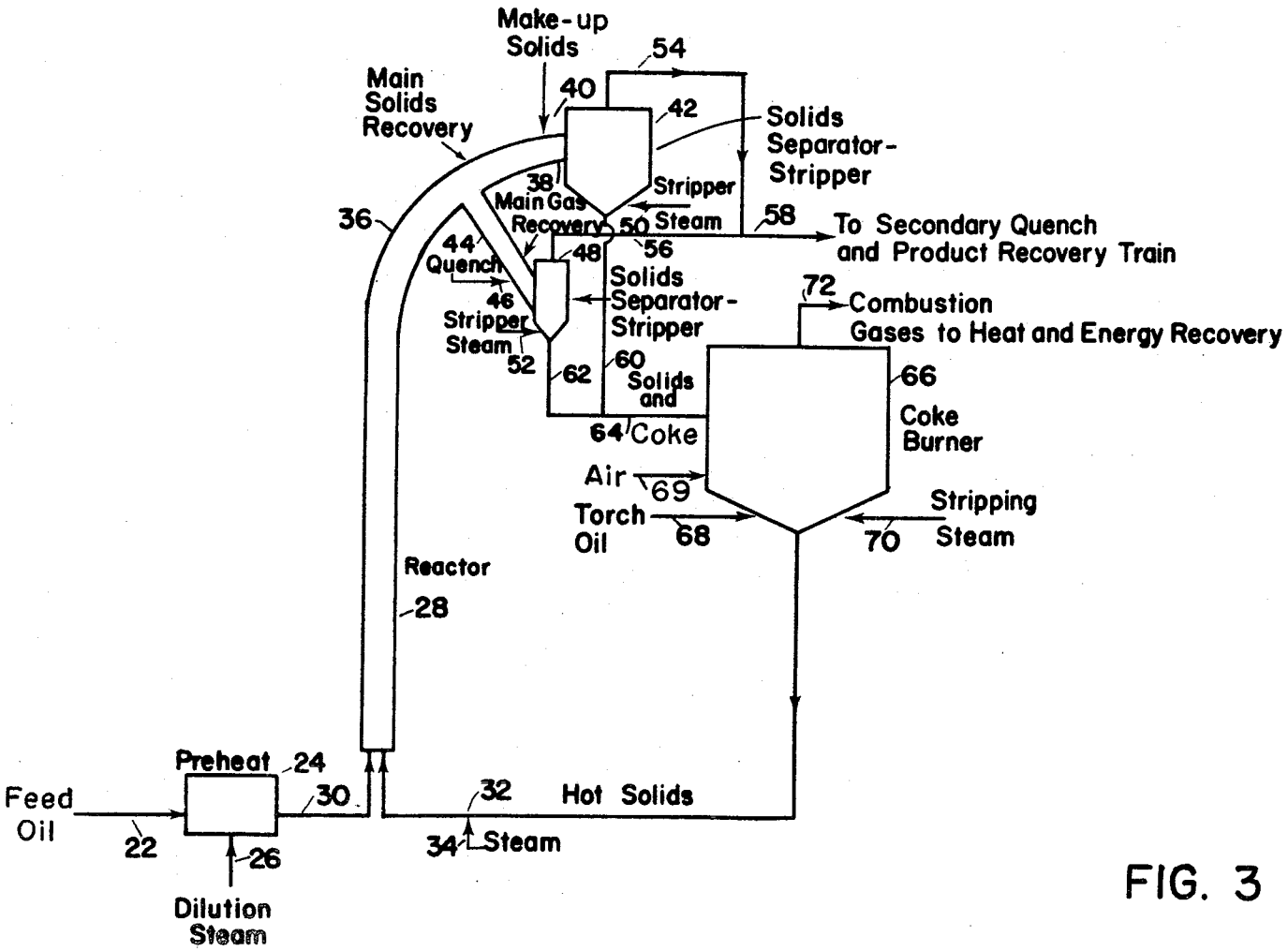

The process of this invention is illustrated in FIG. 3. As shown in FIG. 3, shale feed oil entering through line 22 passes through preheater 24, is admixed with dilution steam entering through line 26 and then flows to the bottom of thermal cracking reactor 28 through line 30.

A steam of hot regenerated solids is charged through line 32 and admixed with fluidizing steam entering through line 34 prior to entering the bottom of riser 28. The oil, steam and hot solids pass in entrained flow upwardly through riser 28 and are discharged through a curved segment 36 at the top of the riser to induce centrifugal separation of solids from the effluent stream. A stream containing most of the solids passes through riser discharge segment 38 and can be mixed, if desired, with make-up solids entering through line 40 before entering solids separator-stripper 42. Another stream containing most of the cracked product is discharged axially through conduit 44 and can be cooled by means of a quench stream entering through line 46 in advance of solids separator-stripper 48.

Stripper steam is charged to solids separators 42 and 48 through lines 50 and 52, respectively. Product streams are removed from solids separators 42 and 48 through lines 54 and 56, respectively, and then combined in line 58 for passage to a secondary quench and product recovery train, not shown. Coke-laden solids are removed from solids separators 42 and 48 through lines 60 and 62, respectively, and combined in line 64 for passage to coke burner 66. If required, torch oil can be added to burner 66 through line 68 while stripping steam is added through line 70 to strip combustion gases from the heated solids. Air is charged to the burner through line 69. Combustion gases are removed from the burner through line 72 for passage to heat and energy recovery systems, not shown, while regenerated hot solids which are relatively free of coke are removed from the burner through line 32 for recycle to riser 28.

We claim:

1. A process for thermal cracking of retorted nickel and vanadium ash-containing shale oil residue to produce a product including hydrogen, ethylene, propylene and 1,3-butadiene which also includes at least 40 weight percent liquids comprising passing retorted shale oil and entrained inert hot solids through a cracking zone at a temperature between 1,430° and 2,500° F. for a residence time of 0.05 to 0.5 seconds, and quenching said product to a temperature below 1,300° F. immediately upon leaving said cracking zone.

2. The process of claim 1 wherein non-hydrotreated shale oil is cracked.

3. The process of claim 1 wherein non-filtered shale oil is cracked.

4. The process of claim 1 wherein the pressure is between 3 and 100 psig.

5. The process of claim 1 wherein the temperature is between 1,430° and 2,000° F.

6. The process of claim 1 wherein the weight ratio of solids to shale oil is between 4:1 and 100:1.

7. The process of claim 1 wherein said solids contain at least 80 percent of process heat requirements.

8. The process of claim 1 including an external coke burner zone utilizing continuous circulation of solids through the coke burner zone.

9. The process of claim 1 wherein the cracking zone comprises a vertical riser.

10. The process of claim 1 wherein said product includes at least 50 weight percent liquids.

* * * * *